US006835109B2

(12) United States Patent
Takada et al.

(10) Patent No.: US 6,835,109 B2
(45) Date of Patent: Dec. 28, 2004

(54) SHIFT MECHANISM FOR OUTBOARD MOTOR

(75) Inventors: Hideaki Takada, Wako (JP); Hiroshi Mizuguchi, Wako (JP); Toyoshi Yasuda, Wako (JP); Hiroshi Watabe, Wako (JP); Shigeo Terada, Wako (JP); Yoshinori Masubuchi, Wako (JP); Taiichi Otobe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/446,967

(22) Filed: May 29, 2003

(65) Prior Publication Data

US 2003/0224672 A1 Dec. 4, 2003

(30) Foreign Application Priority Data

May 31, 2002 (JP) ..... 2002-160320

(51) Int. Cl.[7] ..... B63H 20/14
(52) U.S. Cl. ..... 440/75; 440/86
(58) Field of Search ..... 440/86, 75; 192/84.1–84.31

(56) References Cited

U.S. PATENT DOCUMENTS 3,919,964 A * 11/1975 Hagen ..... 440/75
4,865,570 A * 9/1989 Higby et al. ..... 440/86
5,230,643 A * 7/1993 Kanno ..... 440/86
6,217,400 B1 * 4/2001 Natsume ..... 440/75
6,346,017 B1 * 2/2002 Silorey et al. ..... 440/75

* cited by examiner

*Primary Examiner*—Ed Swinehart
(74) *Attorney, Agent, or Firm*—Westerman, Hattori, Daniels & Adrian, LLP

(57) ABSTRACT

In an outboard motor mounted on a stern of a boat and having an internal combustion engine at its upper portion and a propeller at its lower portion that is powered by the engine to propel the boat, and having a shift mechanism comprising a clutch installed in the outboard motor to be engaged from with a forward gear that causes the boat to be propelled in a forward direction or a reverse gear that causes the boat to be propelled in a reverse direction, a shift rod movably installed in the outboard motor, and a shift slider connected to the shift rod to slide to a position at which the clutch is engaged with the forward gear or a position at which the clutch is engaged with the reverse gear, an actuator such as an electric motor is installed in the outboard motor to move the shift rod. The arrangement can mitigate the load than that under manual operation and offer improved operation feel, without leading to an increase in number of components or weight, and in addition, the required installation space at the hull is no longer needed.

9 Claims, 13 Drawing Sheets

SHIFT MECHANISM FOR OUTBOARD MOTOR

BACKGROUND OF THE INVENTION

1. Field of the Invention

This invention relates to a shift mechanism for an outboard motor.

2. Description of the Related Art

In outboard motor shift mechanisms, shift is usually changed by moving a shift rod having a cam at its distal end in the longitudinal direction to slide a shift slider such that a clutch is switched from its neutral position to a forward position where it engages with a forward gear or a reverse position where it engages with a reverse gear.

Alternatively, as shown in FIG. 13, a shift rod 200 is provided with a rod pin 202 at a position eccentric from the rod center 200*c*, in such a way that a shift slider 204 is slid to effect shift by a distance due to a displacement of the rod pin 202 caused by a rotation of the shift rod 200 in a direction indicated by an arrow. The distance of travel of the rod pin 2002 corresponds to a circular arc whose radius is the amount of eccentricity of the rod pin 202. The angle of rotation of the shift rod 200 (i.e., the displacement angle of the rod pin 202) when the clutch engages with the forward gear or reverse gear (more specifically, when the clutch is in-gear), is about plus/minus 30 degrees, when the neutral position of the rod pin 202 (shown by a phantom line) is defined as zero.

In the outboard motor shift mechanisms including that illustrated in FIG. 13, when the shift rod is operated manually, since the operator tends to have an unpleasant operation "feel" owing to, for instance, heavy load, it has hitherto, been proposed installing an actuator at the hull and connecting it with the shift rod in the outboard motor through a cable or a link mechanism to power-assist the driving of the shift rod, i.e. the shift. The add-on system using such an actuator has disadvantages that its structure is complicated, that it adds to the number and weight of the components, and it needs a space for the actuator at the hull.

Moreover, since the angular range of rotation of the shift rod when the clutch is engaged (in-gear), approximately plus/minus 30 degrees as mentioned above, this causes the shift slider to produces a reaction force to return to the neutral position, that acts on the shift rod as a torque to rotate it. In order to ensure the "in-gear" state, it becomes necessary to add a retainer that can retain the shift rod at that angle against the force. This makes the structure more complicated and increases the number and weight of the components.

SUMMARY OF THE INVENTION

An object of the present invention is therefore to overcome the foregoing issues by providing a shift mechanism for an outboard motor that improves operation feel, is simply configured to avoid an increase in the number of components and weight, while avoiding a problem regarding space utilization.

In order to achieve the foregoing object, this invention provides a shift mechanism for an outboard motor mounted on a stern of a boat and having an internal combustion engine at its upper portion and a propeller at its lower portion that is powered by the engine to propel the boat, comprising: a clutch installed in the outboard motor to be engaged from a neutral position with at least one of a forward gear that causes the boat to be propelled in a forward direction and a reverse gear that causes the boat to be propelled in a direction reverse to the forward direction; a shift rod movably installed in the outboard motor; an actuator installed in the outboard motor to move the shift rod; and a shift slider, installed in the outboard and connected to the shift rod to slide to at least one of a position at which the clutch is engaged with the forward gear and a position at which the clutch is engaged with the reverse gear.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

A shift mechanism of an outboard motor according to an embodiment of the present invention will now be explained with reference to the attached drawings.

Figure 1:
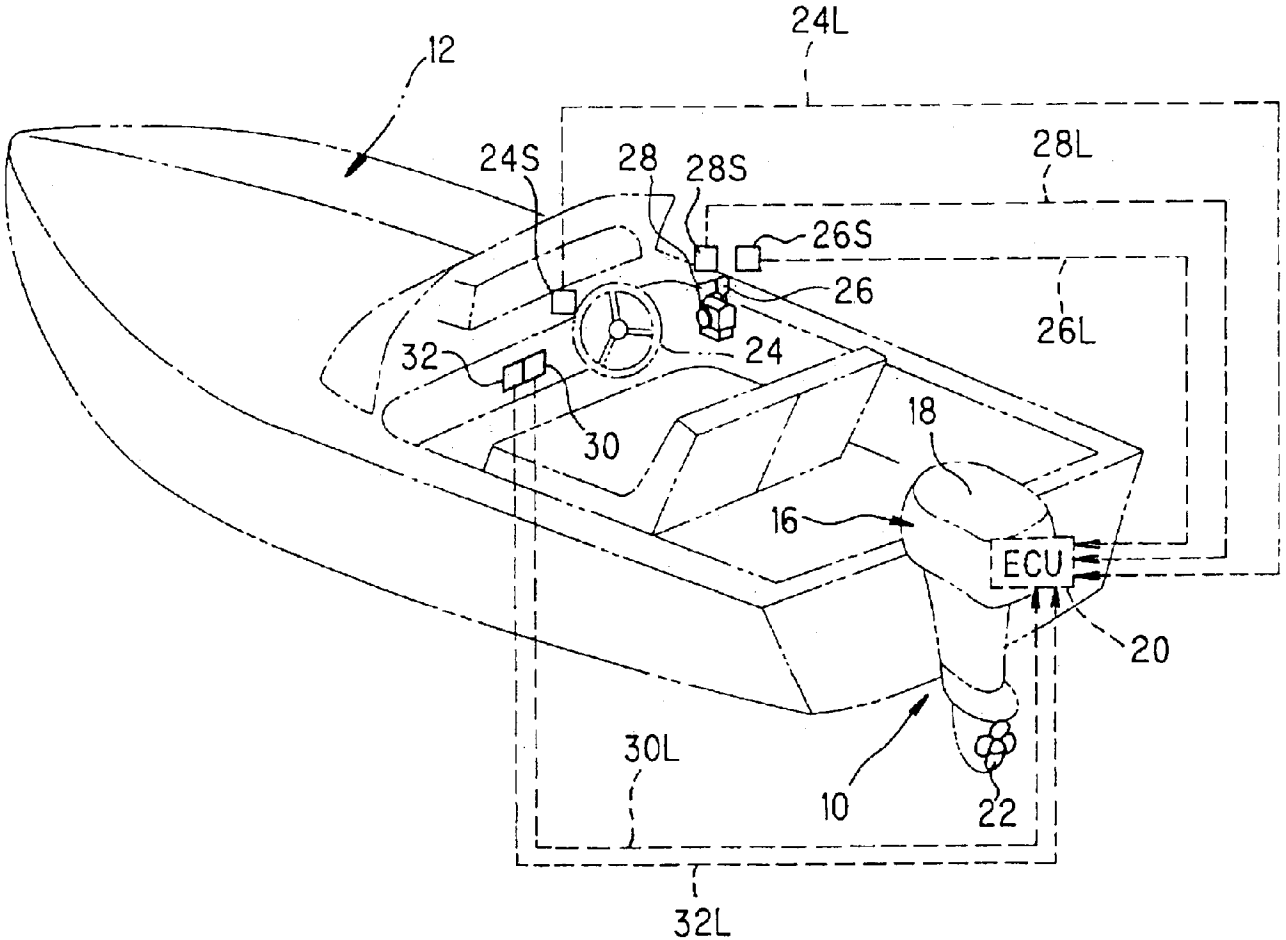
FIG. 1 is an overall schematic view of a shift mechanism for an outboard motor according to an embodiment of the invention.
Figure 2:
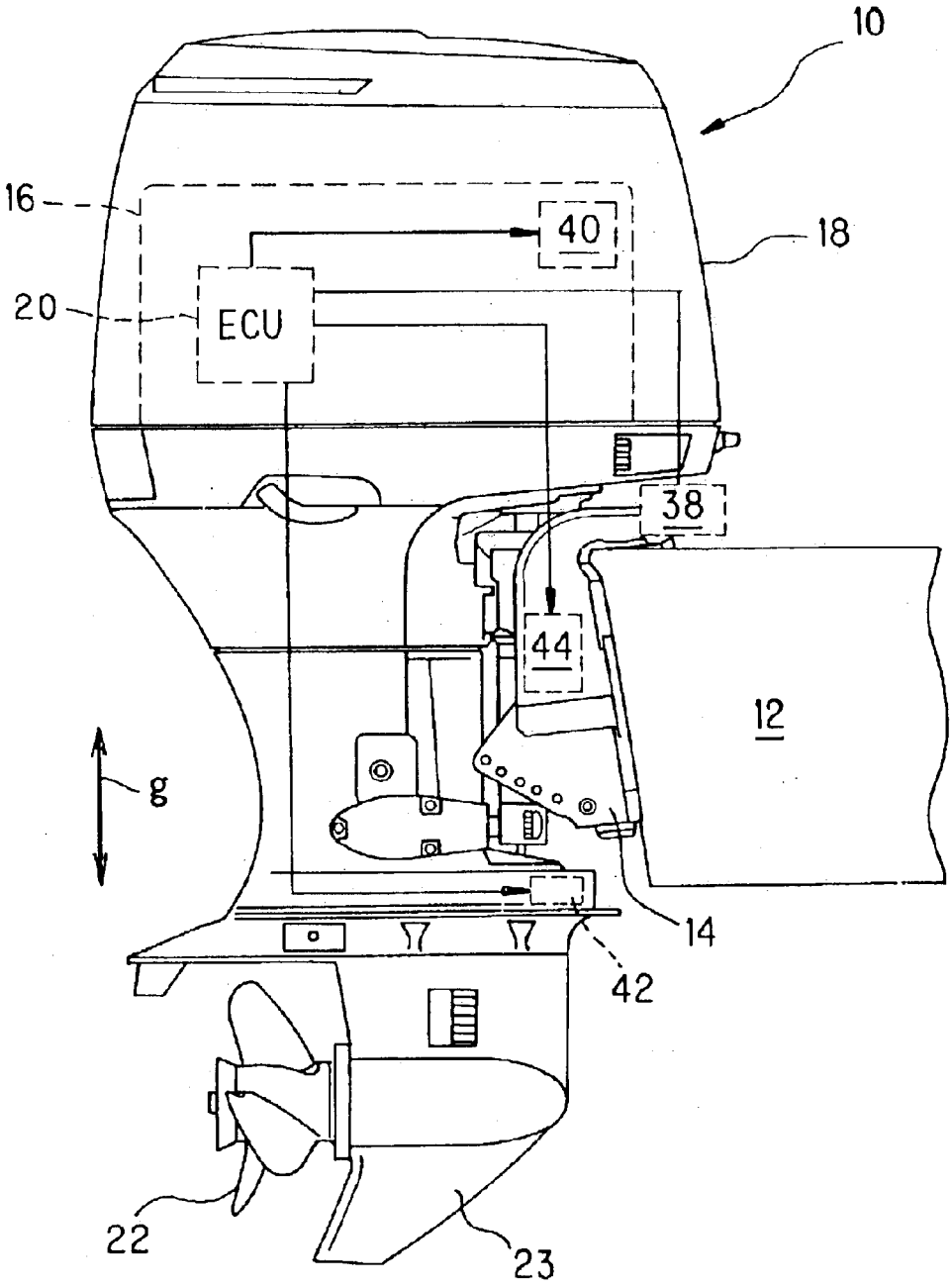
FIG. 2 is an explanatory side view of a part of FIG. 1.

FIG. 1 is an overall schematic view of the shift mechanism for an outboard motor, and FIG. 2 is an explanatory side view of a part of FIG. 1.

Reference numeral 10 in FIGS. 1 and 2 designates an outboard motor built integrally for an internal combustion engine, propeller shaft, propeller and other components. The outboard motor 10 is mounted on the stern of a hull (boat) 12 via stern brackets 14 (shown in FIG. 2).

As shown in FIG. 2, the outboard motor 10 is equipped with an internal combustion engine 16 at its upper portion (in the gravitational direction indicated by the arrow g). The engine 16 is a spark-ignition, in-line four-cylinder gasoline engine with a displacement of 2,200 cc. The engine 16, located inside the outboard motor 10, is enclosed by an engine cover 18 and positioned above the water surface. An electronic control unit (ECU) 20 constituted of a microcomputer is installed near the engine 16 enclosed by the engine cover 18.

The outboard motor 10 is equipped at its lower part with a propeller 22 and a rudder 23. The rudder 23 is fixed near the propeller 22 and does not rotate independently. The propeller 22, which operates to propel the boat 12 in the forward and reverse directions, is powered by the engine 16 through a crankshaft, drive shaft, gear mechanism and shift mechanism (none of which is shown), as will be explained later.

As shown in FIG. 1, a steering wheel 24 is installed near the operator's seat of the boat 12, and a steering angle sensor 24S installed near the steering wheel 24 outputs a signal in response to the turning of the steering wheel 24 by the operator. A throttle lever 26 is mounted on the right side of the operator's seat, and a throttle lever position sensor 26S installed near the throttle lever 26 outputs a signal in response to the position of the throttle lever 26 by the operator.

A shift lever 28 is mounted on the right side of the operator's seat near the throttle lever 26, and a shift lever position sensor 28S is installed near the shift lever 28 and outputs a signal in response to the position of the shift lever 28 by the operator.

A power tilt switch 30 for regulating the tilt angle and a power trim switch 32 for regulating the trim angle of the outboard motor 10 are also installed near the operator's seat. These switches output signals in response to tilt up/down and trim up/down instructions input by the operator. The outputs of the steering angle sensor 24S, power tilt switch 30 and power trim switch 32 are sent to the ECU 20 over signal lines 24L, 30L and 32L.

In response to the output of the steering angle sensor 24S sent over the signal line 24L, the ECU 20 operates an electric motor 38 (for steer; shown in FIG. 2) to steer the outboard motor 10, i.e., change the direction of the propeller 22 and rudder 23, and thereby turn the boat 12 right or left.

In response to the output of the throttle lever position sensor 26S sent over the signal line 26L, the ECU 20 operates an electric motor 40 (for throttle) to move the throttle valve and regulate the amount of air to be sucked into the engine 16. Further, in response to the output of the shift lever position sensor 28S sent over the signal line 28L, the ECU 20 operates an electric motor 42 (for shift) to change the rotational direction of the propeller 22 or cut off the transmission of engine power to the propeller 22.

Moreover, in response to the outputs of the power tilt switch 30 and power trim switch 32 sent over the signal lines 30L, 32L, the ECU 20 operates a conventional power tilt-trim unit 44 to regulate the tilt angle and trim angle of the outboard motor 10.

Figure 3:
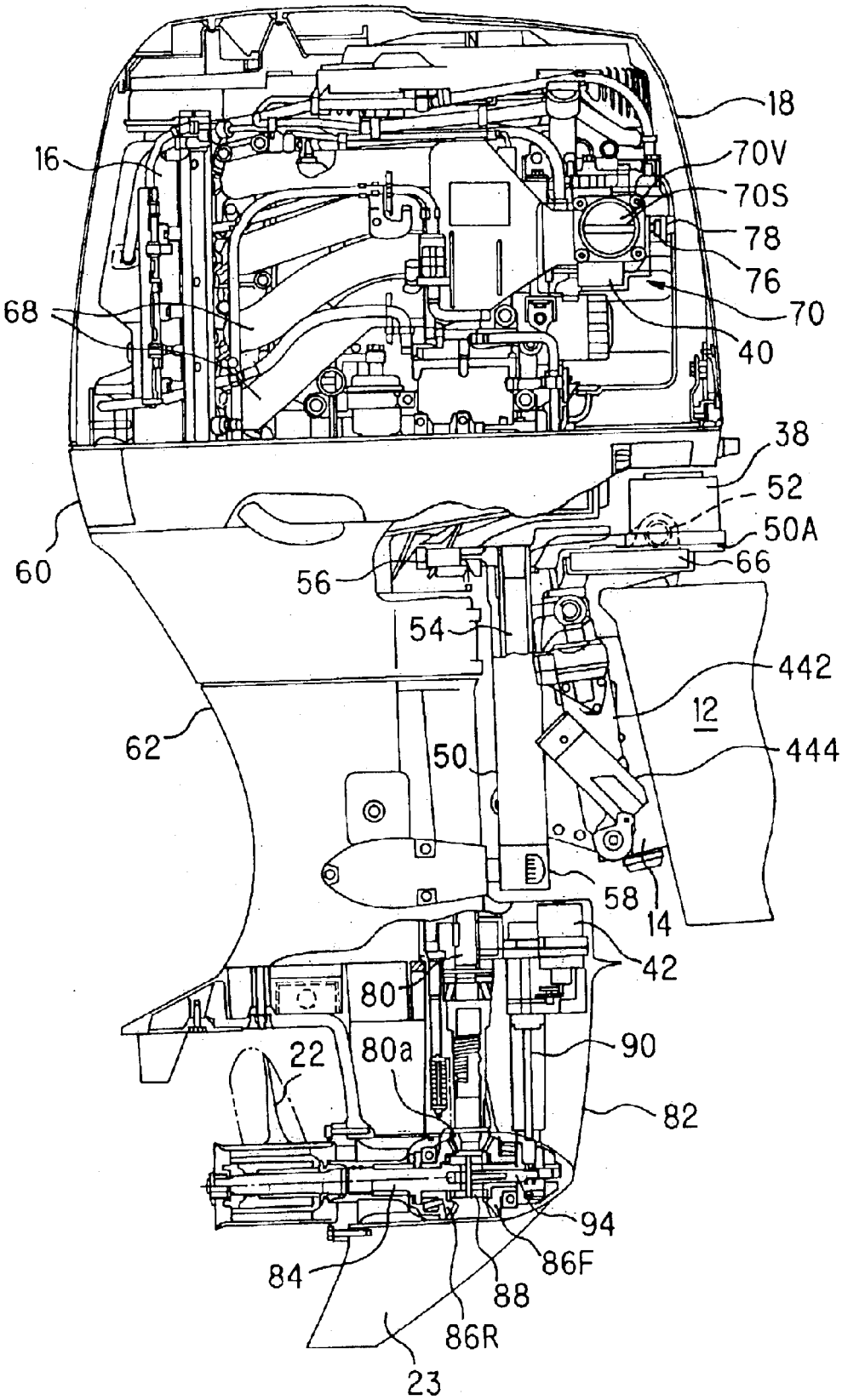
FIG. 3 is an enlarged explanatory side view of FIG. 2.

FIG. 3 is an enlarged explanatory side view. While this is basically an enlargement of FIG. 2, it should be noted that it is portrayed in a partially cutaway manner with the right side of the stern bracket 14 removed (the right side looking forward (toward the boat or hull 12)).

As illustrated in FIG. 3, the power tilt-trim unit 44 is equipped with one hydraulic cylinder 442 for tilt angle regulation (hereinafter called the "tilt hydraulic cylinder") and, constituted integrally therewith, two hydraulic cylinders 444 for trim angle regulation (hereinafter called the "trim hydraulic cylinders"; only one shown).

As shown in FIG. 3, one end of the tilt hydraulic cylinder 442 is fastened to the stern bracket 14 and through it to the boat 12 and the other end (piston rod) thereof is fastened to a swivel case 50. One end of each trim hydraulic cylinder 444 is fastened to the stern bracket 14 and through it to the boat 12, similarly to the one end of the tilt hydraulic cylinder 442, and the other end (piston rod) thereof abuts on the swivel case 50.

The swivel case 50 is connected to the stern bracket 14 through a tilting shaft 52 to be relatively displaceable about the tilting shaft 52. A swivel shaft (steering shaft) 54 is rotatably accommodated inside the swivel case 50. The swivel shaft 54 has its upper end fastened to a mount frame 56 and its lower end fastened to a lower mount center housing 58. The mount frame 56 and lower mount center housing 58 are fastened to an under cover 60 and an extension case 62 (more exactly, to mounts covered by these members). The outboard motor 10 is, broadly speaking, mounted on the boat or hull 12 through the mount frame 56.

The electric motor 38 (for steer) and a gearbox (gear mechanism) 66 for reducing the output of the electric motor 38 are fastened to an upper portion 50A of the swivel case 50. The gearbox 66 is connected to the output shaft of the electric motor 38 at its input side and is connected to the mount frame 56 at its output side. To be more specific, horizontal steering of the outboard motor 10 is thus power-assisted using the rotational output of the electric motor 38 to swivel the mount frame 56 and thus turn the propeller 22 and rudder 23. The overall rudder turning angle of the outboard motor 10 is 60 degrees, 30 degrees to the left and 30 degrees to the right.

As shown in the figure, the engine 16 is installed at the upper portion of the under cover 60 and the engine cover 18 is fastened thereon to cover the engine 16. The engine 16 has a throttle body 70 that is placed at a front position (at a position close to the hull or boat 12) inside the engine cover 18.

The throttle body 70 is integrally fastened with the electric throttle motor (DC motor; actuator) 40. Specifically, the electric motor 40 is connected to a throttle shaft 70S through a gear mechanism (not shown) provided adjacent to the throttle body 70. The throttle shaft 70S supports or carries the throttle valve 70V in such a way that the valve 70V rotates about the shaft 70S.

The throttle shaft 70S is provided with a knob 76 at the end close to the hull or boat 12. The knob 76 is formed in a shape such that the operator can easily pinch and rotate to move the throttle valve 70V manually. The knob 76 is concealed by a cover 78 (that is detachable). After removing the engine cover 18 and the cover 78, the operator can easily handle the knob 76 from the boat or hull 12.

Sucked air flows to the throttle body 70 and is regulated by a throttle valve 70V and the regulated air then flows through an intake manifold 68 to the cylinders and is mixed with gasoline fuel injected by a fuel injector (not shown) and resultant air-fuel-mixture is supplied into the cylinders. The air-fuel mixture in the cylinder is combusted and resulting output (engine power) is transmitted, via a crankshaft (not shown) and a drive shaft 80, to a propeller shaft 84 housed in a gear case 82 and to rotate the propeller 22. The rudder 23 is formed integrally with the gear case 82.

Figure 4:
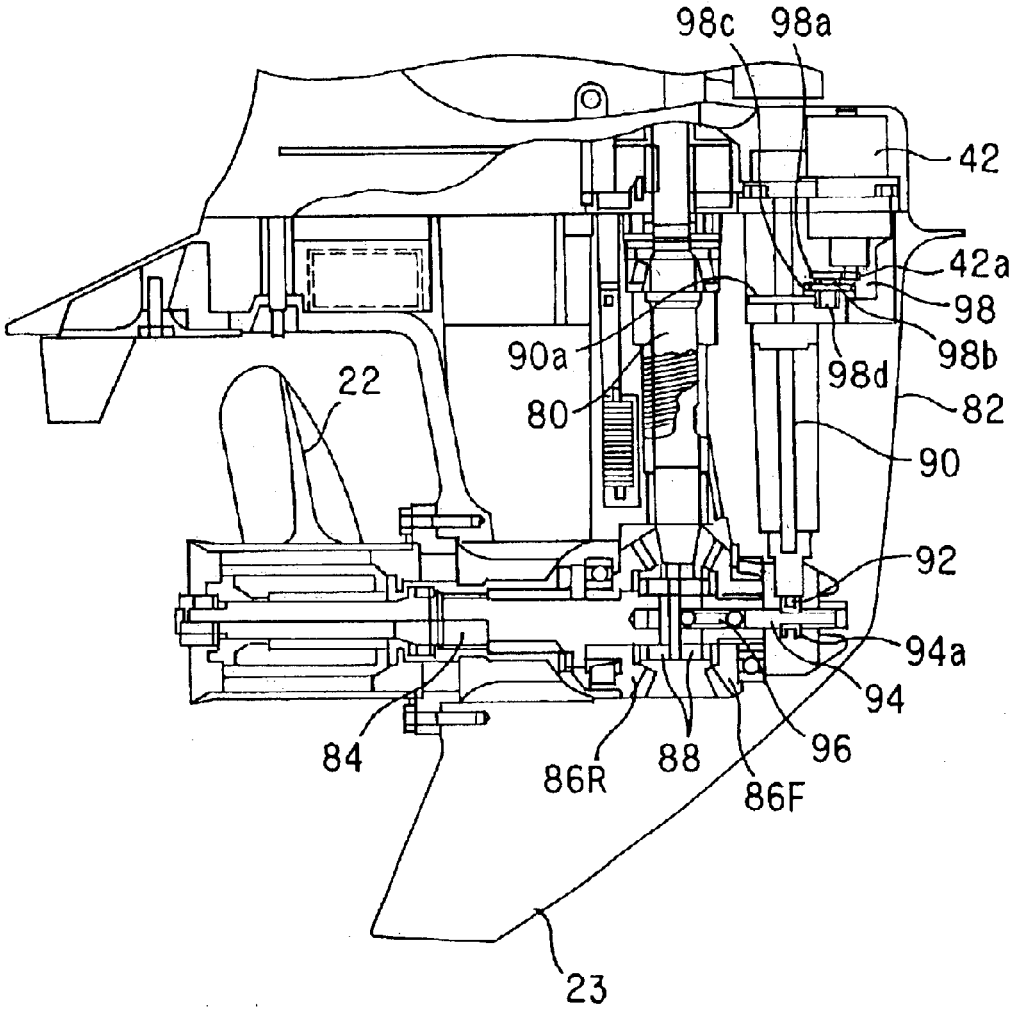
FIG. 4 is an enlarged sectional view of FIG. 3.

FIG. 4 is an enlarged sectional view (of FIG. 3) showing the gear case 82.

With reference to FIG. 4, the power transmission to the propeller shaft 84 will be explained in detail.

As shown in the figure, the propeller shaft 84 is provided with a forward gear 86F and a reverse gear 86R therearound, respective of which meshes with a drive gear 80*a* fixed to the drive shaft 80 and rotates in opposite directions. A clutch 88 is provided between the forward gear 86F and the reverse gear 86R to be rotated with the propeller shaft 84.

The gear case 82 rotatably accommodates a shift rod 90. The shift rod 90 is formed with, at its end surface, a rod pin 92 at a position eccentric to the shaft center axis. The rod pin 92 is inserted into a cavity 94*a* formed on a shift slider 94 that is installed below the shift rod 90. The shift slider 94 is made slidable along a line extended from the propeller shaft 84 and the clutch 88, and is connected to the clutch 88 through a spring 96. The swivel shaft 54 is positioned above a line extended from the shift rod 90, as shown in FIG. 3.

Figure 5A:
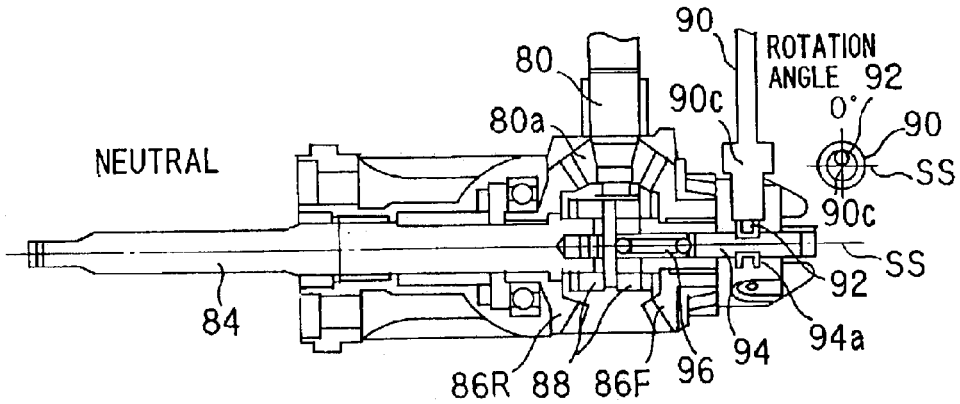
FIG. 5A to 5C are a set of explanatory sectional views showing the angles of rotation of the rod pin (illustrated in FIG. 4) at each shift, i.e., neutral, forward and reverse.
Figure 5B:
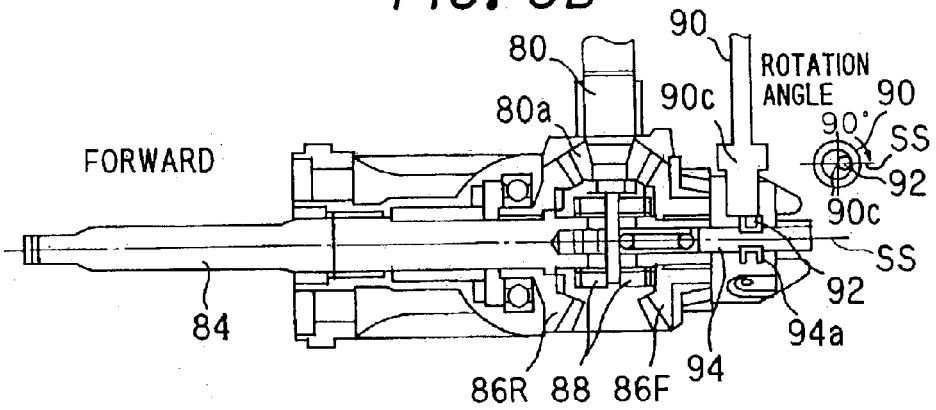
Figure 5C:
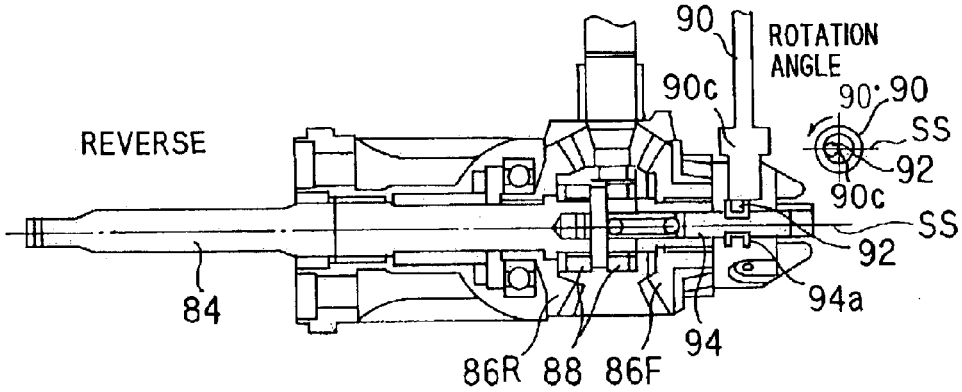

FIGS. 5A to 5C are a set of explanatory sectional views showing the angles of rotation of the rod pin 92 at each shift, i.e., neutral, forward and reverse. As illustrated in the figures, in response to a rotation of the shift rod 90, the rod pin 92 displaces along a locus of circular arc whose radius is corresponding to the amount of eccentricity from the center axis 90*c* of the shift rod 90. Specifically, in response to the rotation of the shift rod 90, the rod pin 92 displaces in a direction in which the shift slider 94 slides, i.e., in the direction of a line SS extended from center axis of the shift slider 94. With this, the shift slider 94 slides by the action of the cavity 94*a*, and the clutch 88 is brought into engagement with the forward gear 86F or the reverse gear 86R, or is held at the neutral position.

More specifically, as illustrated in FIG. 5A, at the neutral position, a line connecting the shift rod's center axis 90*c* and the rod pin 92 intersects the line SS extended from the center axis of the shift slider 94. The angle of rotation of the shift rod 90 at this time is defined as zero. When the shift rod's angle of rotation is zero, the clutch 88 is not engaged with the forward gear 86F and the reverse gear 86R.

As illustrated in FIG. 5B, when the shift rod 90 is rotated clockwise (in the figure) by 90 degrees from the neutral position, in other words, when the shift rod 90 is rotated such that the rod pin 92 is positioned on the line SS, the rod pin 92 displaces in the direction of the line SS by an amount corresponding to the amount of eccentricity. As a result, the shift slider 94 slides, through the cavity 94*a*, right (in the figure) in the direction of the line SS, and the clutch 88 is engaged with the forward gear 86F.

This is the same as the shift in reverse. Specifically, as illustrated in FIG. 5C, when the shift rod 90 is rotated counterclockwise (in the figure) by 90 degrees from the neutral position such that the rod pin 92 is positioned on the line SS, the rod pin 92 displaces in the direction of the line SS by an amount corresponding to the amount of eccentricity, the shift slider 94 slides, through the cavity 94*a*, left (in the figure) in the direction of the line SS, and the clutch 88 is engaged with the reverse gear 86R.

Figure 6:
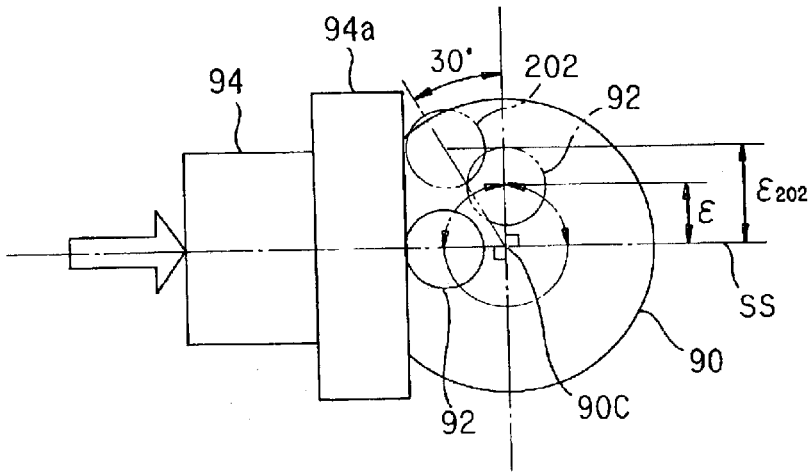
FIG. 6 is an explanatory partial plan view showing an electric motor, a shift rod and a gear mechanism illustrated in FIG. 4.

Thus, in the shift mechanism according to the embodiment, as illustrated in FIG. 6, the angle of rotation (more precisely, the angular range of rotation) of the shift rod 90 is set to be approximately plus/minus 90 degrees, when the position of the rod pin 92 at the neutral (shown by phantom line) is defined as 0 degree. In other words, the angle of rotation of the shift rod 90 is set to be a range of 180 degrees beginning from the line SS extended from the center axis of the shift slider 94 and ending at the same line SS, such that the shift slider 94, the rod pin 92 and the center axis 90*c* of the shift rod 90 are aligned at the same straight line. With this, the reaction force from the shift slider to return to the neutral position does not act on the shift rod 90 as the torque to rotate it. Accordingly, in order to ensure the "in-gear" state, it is no longer necessary to add a retainer that retains the rotation of the shift rod 90 at the in-gear state. This makes the structure simple and can prevent the increase in number and weight of the components.

Moreover, as shown in the figure, since the shift rod's angle of rotation (more precisely, the angular rotation) is set to be plus/minus 90 degrees, the amount of eccentricity $\epsilon$ can be decreased when compared to the prior art in which it is set to be plus/minus 30 degrees. In other words, the same amount of slide can be achieved by a less amount of eccentricity than the prior art. The prior art rod pin is shown by reference numeral 202 and its amount of eccentricity is shown by $\epsilon$202. With this, it becomes possible to decrease the radium of load (i.e., the amount of eccentricity $\epsilon$) and hence, to decrease a torque necessary for driving the shift rod 90. For ease of illustration, the cavity 94*a*, etc., is simplified.

Returning to the explanation of FIG. 4, the shift rod 90 is connected with the aforesaid electric motor (for shift) 42 (DC motor; actuator) through a gear mechanism 98 in the gear case 82.

Figure 7:
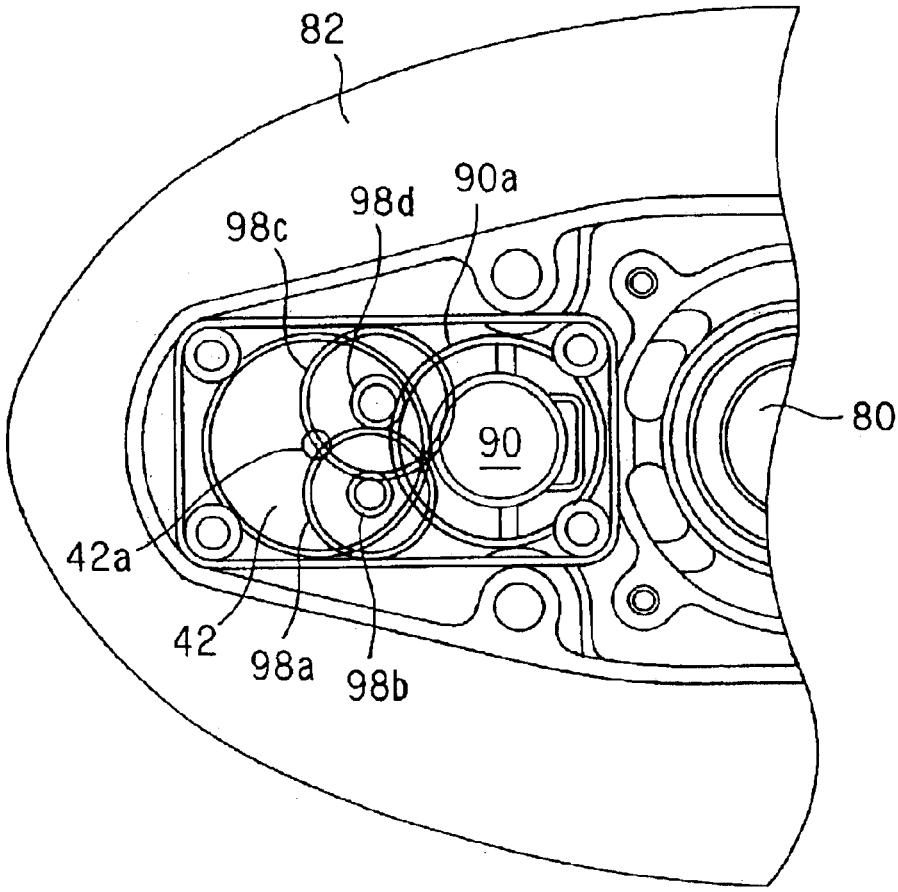
FIG. 7 is an explanatory partial plan view showing the electric motor, the shift rod and the gear mechanism illustrated in FIG. 4.

FIG. 7 is an explanatory partial plan view showing the electric motor 42, the shift rod 90 and the gear mechanism 98 in the gear case 82. As illustrated in FIG. 7 (and FIG. 4), the electric motor 42 has an output shaft gear 42*a*, fixed to its output shaft, that meshes with a first gear 98*a* of a larger diameter (having more teeth) than the output shaft gear 42*a*. The first gear 98*a* meshes with a second gear 98*b* (of a fewer diameter (having fewer teeth) than the first gear 98*a*) which in turn meshes with a third gear 98*c* of a larger diameter (having more teeth). A fourth gear 98*d* of a fewer diameter (having fewer teeth) than the third gear 98*c* is fastened to the third gear 98*c* coaxially therewith.

The shift rod 90 is provided with a shift rod gear 90*a* of a larger diameter (having more teeth than the fourth gear 98*d*) that meshes with the fourth gear 98*d* to transmit the geared-down output of the electric motor 42 to the shift rod 90. Thus, the shift is power-assisted by the operating the electric motor 42 to rotate the shift rod 90 about its center axis.

As mentioned in the above, since the electric motor 42 is housed or installed in the outboard motor 10 in such manner that the electric motor 42 drives or rotates the shift rod 90, this can mitigate the load than that under manual operation and offer improved operation feel. Further, since the electric motor 42 is connected to the shift rod 90 with the use of the gear mechanism 98 that is simpler than a cable or a link mechanism, this does not lead to an increase in number of components or weight, and in addition, the required installation space at the hull 12 is no longer needed.

Further, since the electric motor 42 is placed or housed in the gear case 82 which accommodates the clutch 88, the shift rod 90 and the shift slider 94, it becomes possible to reduce the entire length of the shift rod 90, thereby further decreasing the required installation space and weight of the shift mechanism.

Figure 8:
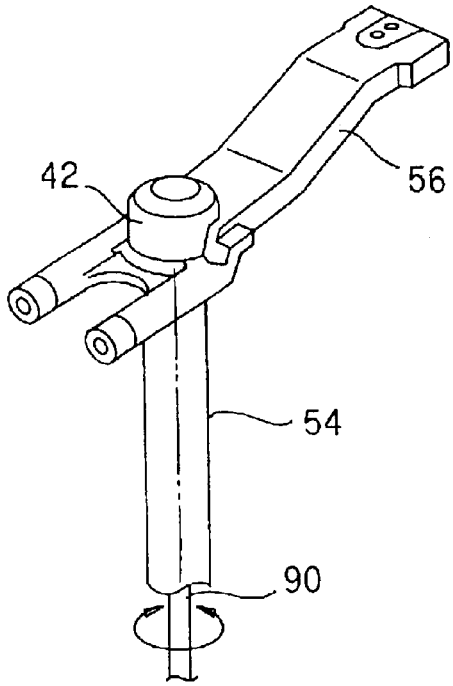
FIG. 8 is an explanatory enlarged view partially showing a shift mechanism for outboard motors according to a second embodiment of the invention.

FIG. 8 is an explanatory enlarged view partially showing a shift mechanism for outboard motors according to a second embodiment of the invention.

Explaining the shift mechanism according to the second embodiment with focus on the differences from the first embodiment, as illustrated in the figure, the electric motor 42 is located above the mount frame 56. More specifically, the electric motor 42 is installed at a position above the junction of the mount frame 56 and the swivel case 50 (not shown), i.e., at a position above the axis of the swivel shaft (steering shaft) 54.

Further, in the shift mechanism according to the second embodiment, the shift rod 90 is elongated upward (in the direction of gravity) in such a way that it passes through inside the lower mount center housing 58 (not shown) and the swivel shaft 54 rotatably and is connected to the electric motor 42. Since the swivel shaft 54 is located on the line extended from center axis of the shift rod 90 as mentioned above, by elongating the shift rod 90 upward in the direction of gravity to pass through the lower mount center housing 58 and the swivel shaft 54, the shift rod 90 can be connected with the electric motor 42 positioned above the mount frame 56. This makes it possible to drive or rotate the shift rod 90 by the electric motor 42 with a simple structure. Since the rest of the configuration is the same as the first embodiment, explanation is omitted.

In the second embodiment, thus, since the electric motor 42 is installed at a position above the mount frame 56 in the outboard motor 10 to drive the shift rod 90, this can also mitigate the load more than that under manual operation and offer improved operation feel. Further, since the connection of the shift rod 90 and the electric motor 42 is more simplified, this leads to more reduced installation space and more reduced weight, and in addition, the required installation space at the hull 12 is no longer needed.

Figure 9:
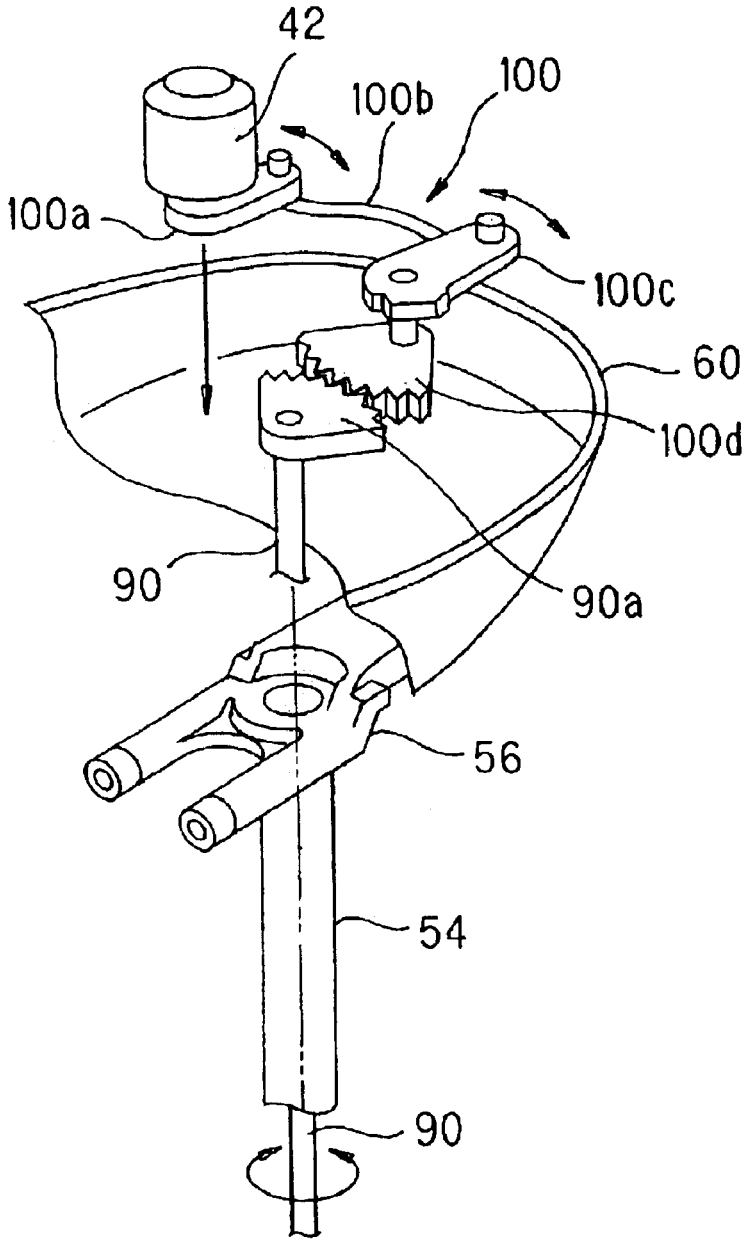
FIG. 9 is an explanatory enlarged view partially showing a shift mechanism for outboard motors according to a third embodiment of the invention.

FIG. 9 is an explanatory enlarged view partially showing a shift mechanism for outboard motors according to a third embodiment of the invention.

Explaining the shift mechanism according to the third embodiment with focus on the differences from the foregoing embodiments, as illustrated in the figure, the electric motor 42 is located above the under cover 60 at the front (at a position close to the hull or boat 12). More specifically, the electric motor 42 is installed at the front (at a position close to the hull 12) in the engine cover 18. Further, the shift rod 90 is similarly elongated upward (in the direction of gravity) in such a way that it passes through the lower mount center housing 58 (not shown), the swivel shaft 54 and the mount frame 56 rotatably to project in the under cover 60.

In the third embodiment, the electric motor 42 and the shift rod 90 is connected by a link mechanism 100. The link mechanism 100 includes a first link 100*a* that is connected to the electric motor 42 at one end and is connected to a link rod 100*b* at the other end. The link rod 100*b* is connected, at the other end, to a second link 100*c* having an arcuate link mechanism gear 100*d* at the other end that meshes with a similar arcuate shift rod gear 90*a* fixed to the shift rod 90. Through this link mechanism 100, the output of the electric motor 42 is transmitted to the shift rod 90 to drive or rotate the same. Notably, parts of the link mechanism 100 such as the first link 100*a* and the link rod 100*b* are installed or placed at positions more, close to the hull 12 than the electric motor 42. Since the rest of the configuration is the same as the first embodiment, explanation is omitted.

In the third embodiment, thus, since electric motor 42 is installed in the engine cover 18 at a position close to the hull 12 to drive the shift rod 90, this can also mitigate the load more than that under manual operation and offer improved operation feel. Further, it can protect the electric motor 42 against sea water, dust and the like and facilitate maintenance operation of the electric motor 42 from the hull 12.

Further, since the shift rod 90 can be driven or rotated, without using the electric motor 42, by manually operating the link mechanism 100, it is still possible to move the shift rod 90 to shift even if the electric motor 42 breaks down. The fact that the parts of the link mechanism 100 are installed or placed at positions more close to the hull 12 than the electric motor 42, can facilitate this manual driving of the shift rod.

Figure 10:
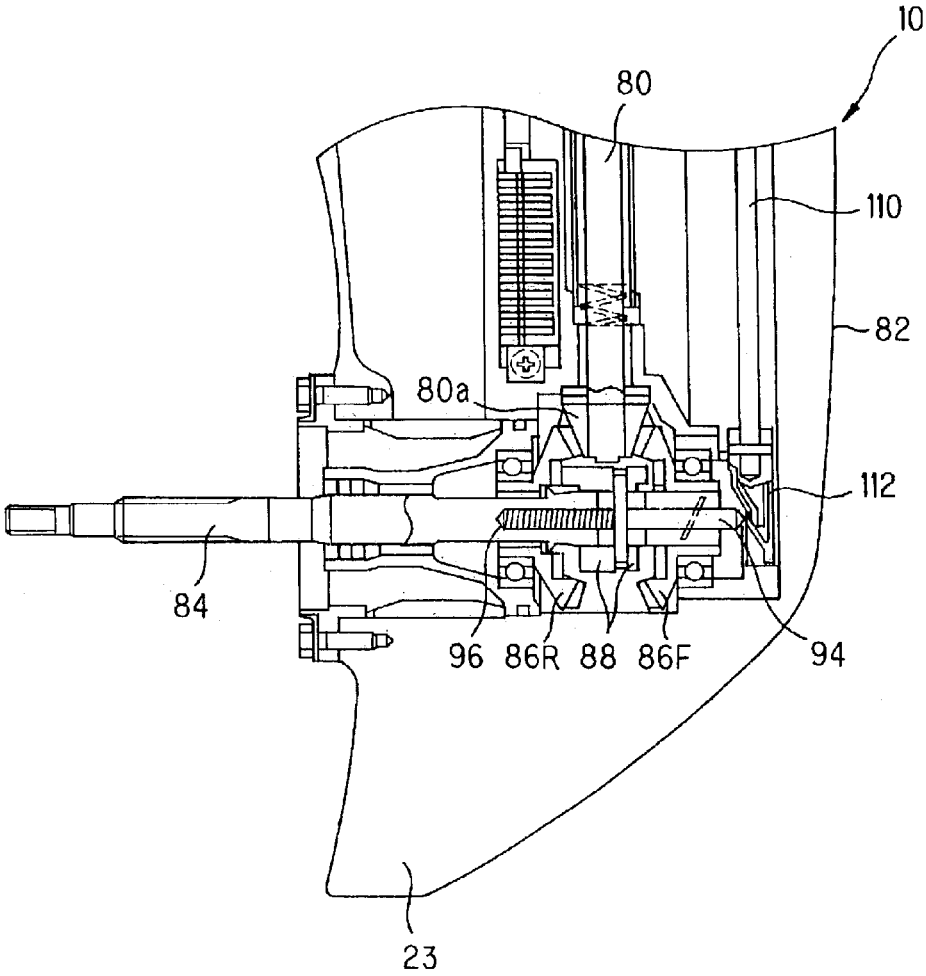
FIG. 10 is an explanatory enlarged view partially showing a shift mechanism for outboard motors according to a fourth embodiment of the invention.

FIG. 10 is an explanatory enlarged view partially showing a shift mechanism for outboard motors according to a fourth embodiment of the invention.

Explaining the shift mechanism according to the fourth embodiment with focus on the differences from the foregoing embodiments, as illustrated in the figure, instead of the shift rod of rotational type, a shift rod 110 of translational type (that moves back-and-forth) is used.

Specifically, as illustrated in FIG. 10, the shift rod 110 is housed in the gear case 82 in the outboard motor 10, and is fixed with a cam 112 at its bottom end. The cam 112 is configured to be three-step stairs formed vertically. As the shift rod 110 is moved up and down vertically in the longitudinal direction, any of the three steps abuts the end of the shift slider 94 such that the shift slider 94 slides to change the clutch position to effect shift.

Figure 11:
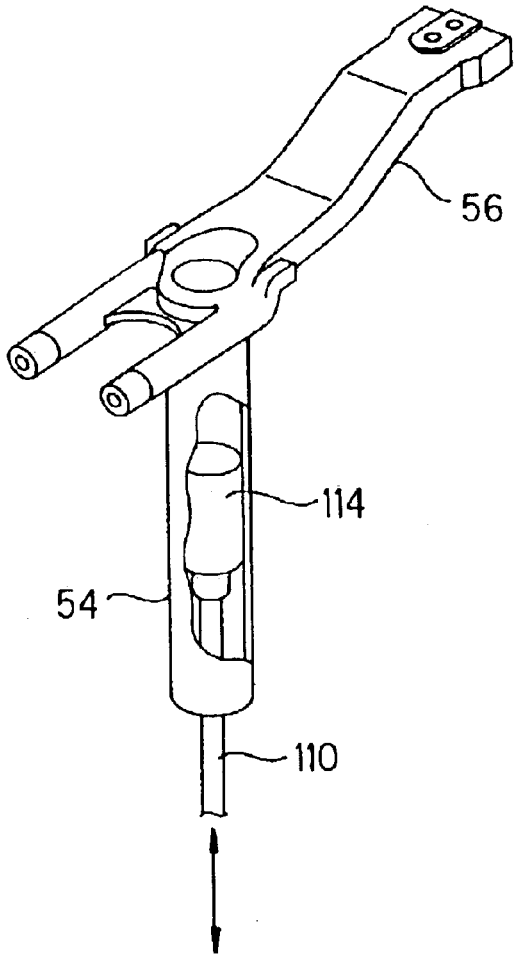
FIG. 11 is an explanatory enlarged partial view similarly showing the shift mechanism for outboard motors according to the fourth embodiment.

FIG. 11 is an explanatory enlarged partial view similarly showing the shift mechanism for outboard motors according to the fourth embodiment.

As illustrated in the figure, in the fourth embodiment, an electromagnetic solenoid 114 is used as an actuator that is housed inside the swivel shaft 54. Further, the shift rod 110 is elongated upward (in the direction of gravity) in such a way that it passes through the lower mount center housing 58 (not shown) and the swivel shaft 54, while being enabled to move up and down, to be connected with the electromagnetic solenoid 114.

Since the swivel shaft 54 is located on the line extended from the center axis of the shift rod 110 as mentioned above, by elongating the shift rod 110 upward in the direction of gravity to pass through the lower mount center housing 58 and the swivel shaft 54, the shift rod 110 can be connected with the electromagnetic solenoid 114 housed in the swivel shaft 54. This makes it possible to drive or rotate the shift rod 110 by the electromagnetic solenoid 114 with a simple structure. As the rest of the configuration is the same as the first embodiment, explanation is omitted.

In the fourth embodiment, thus, since the electromagnetic solenoid 114 is installed inside the swivel shaft 54 (that is positioned on the line extended from the center axis of the shift rod 110) in the outboard motor 10 to drive the shift rod 110, this can also mitigate the load than that under manual operation and offer improved operation feel. Further, since the connection of the shift rod 110 and the electromagnetic solenoid 114 is simplified, this leads to more reduced installation space and more reduced weight, and in addition, the required installation space at the hull 12 is no longer needed.

Figure 12:
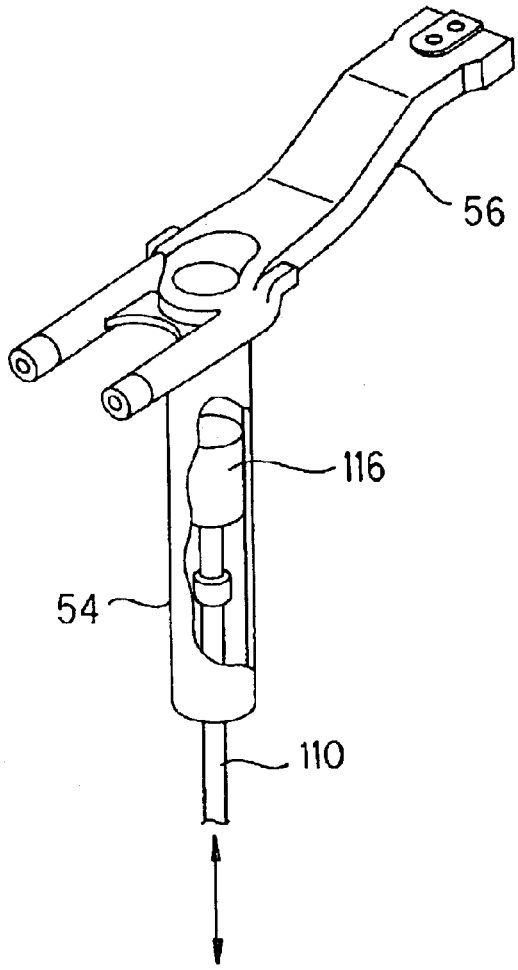
FIG. 12 is an explanatory enlarged view partially showing a shift mechanism for outboard motors according to a fifth embodiment of the invention.
Figure 13:
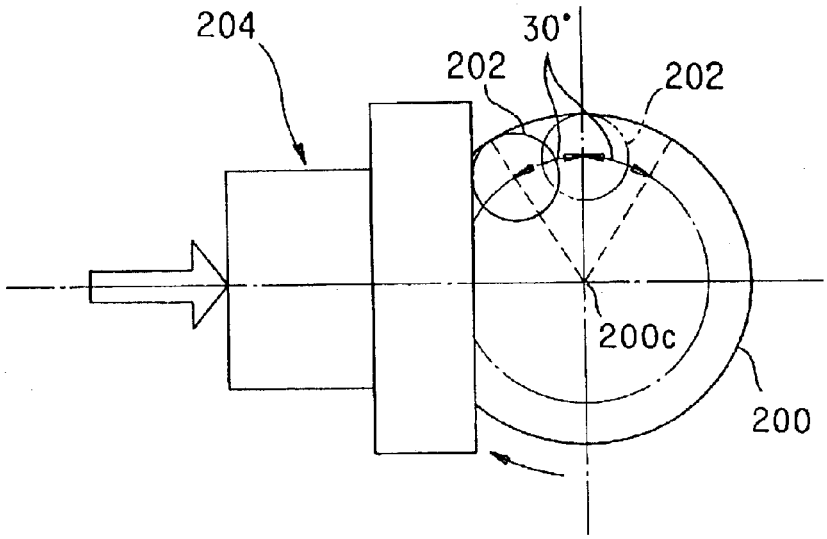
FIG. 13 is a view, similar to FIG. 6, but showing a prior art shift mechanism for an outboard motor.

FIG. 12 is an explanatory enlarged view partially showing a shift mechanism for outboard motors according to a fifth embodiment of the invention.

Explaining the shift mechanism according to the fifth embodiment with focus on the differences from the fourth embodiment, as illustrated in the figure, instead of the electromagnetic solenoid 114, a hydraulic cylinder 116 is used as an actuator to drive the shift rod 110 in the vertical direction. Since the rest of the configuration is the same as the first embodiment, explanation is omitted.

In the fifth embodiment, thus, since the hydraulic cylinder 116, is installed inside the swivel shaft 54 (that is positioned on the line extended from the center axis of the shift rod 110) in the outboard motor 10 to drive the shift rod 110, this can also mitigate the load than that under manual operation and offer improved operation feel. Further, since the connection of the shift rod 110 and the hydraulic cylinder 116 is simplified, this leads to more reduced installation space and: more reduced weight, and in addition, the required installation space at the hull 12 is no longer needed.

As mentioned above, the first to fifth embodiments are configured to provide a shift mechanism for an outboard motor 10 mounted on a stern of a boat (hull) 12 and having an internal combustion engine 16 at its upper portion and a propeller 22 at its lower portion that is powered by the engine to propel the boat, comprising: a clutch 88 installed in the outboard motor to be engaged from a neutral position with at least one of a forward gear 86F that causes the boat to be propelled in a forward direction and a reverse gear 86R that causes the boat to be propelled in a direction reverse to the forward direction; a shift rod 90, 110 movably installed in the outboard motor; an actuator 42, 114, 116 installed in the outboard motor to move the shift rod; and a shift slider 94, installed in the outboard and connected to the shift rod to slide to at least one of a position at which the clutch is engaged with the forward gear and a position at which the clutch is engaged with the reverse gear.

In the shift mechanism, the actuator is installed in a steering shaft (swivel shaft) 54, that is located on a line extended from the shift rod, which causes the propeller to turn, or is installed in a mount frame 56 through which the outboard is mounted on the boat, or is installed in a gear case 82 that accommodates the clutch, the shift rod and the shift slider.

In the shift mechanism, the actuator (electric motor 42) drives the shift rod 90 to rotate such that the shift slider 94 slides to at least one of the position at which the clutch is engaged with the forward gear and the position at which the clutch is engaged with the reverse gear. Specifically, the actuator drives the shift rod 90 to rotate in an angular range of rotation beginning from a line SS extended from a center axis of the shift slider 94 and ending at the same line SS. More specifically, the angular range of ration is approximately plus/minus 90 degrees when a position at which the clutch is at the neutral position is defined as zero degree. In this case, the actuator is an electric motor 42.

In the shift mechanism, the actuator (electromagnetic solenoid 114 or hydraulic cylinder 116) drives the shift rod 110 to move in a longitudinal direction such that the shift slider 94 slides to at least one of the position which the clutch is engaged with the forward gear and the position at which the clutch is engaged with the reverse gear. In this case, the actuator is an electromagnetic solenoid 114 or a hydraulic cylinder 116.

It should be noted in the above, although the electric motor (for shift) 42 is configured to be a DC motor, it may be other motor such as a stepper motor.

The entire disclosure of Japanese Patent Application No. 2002-160320 filed on May 31, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A shift mechanism for an outboard motor mounted on a stern of a boat and having an internal combustion engine at its upper portion and a propeller at its lower portion that is powered by the engine to propel the boat, comprising:

a clutch installed in the outboard motor to be engaged from a neutral position with at least one of a forward gear that causes the boat to be propelled in a forward direction and a reverse gear that causes the boat to be propelled in a direction reverse to the forward direction;

a shift rod movably installed in the outboard motor;

an actuator installed in the outboard motor to move the shift rod; and a shift slider installed in the outboard and connected to the shift rod to slide to at least one of a position at which the clutch is engaged with the forward gear and a position at which the clutch is engaged with the reverse gear, wherein the actuator drives the shift rod to rotate such that the shift slider slides to at least one of the position at which the clutch is engaged with the forward year and the position at which the clutch is engaged with the reverse gear, and wherein the actuator drives the shift rod to rotate in an angular range of rotation beginning from a line extended from a center axis of the shift slider and ending at the same line.

2. A shift mechanism according to claim 1, wherein the actuator is installed in a steering shaft, that is located on a line extended from the shift rod, which causes the propeller to turn.

3. A shift mechanism according to claim 1, wherein the actuator is installed in a mount frame through which the outboard is mounted on the boat.

4. A shift mechanism according to claim 1, wherein the actuator is installed in a gear case that accommodates the clutch, the shift rod and the shift slider.

5. A shift mechanism for an outboard motor mounted on a stern of a boat and having an internal combustion engine at its upper portion and a propeller at its lower portion that is powered by the engine to propel the boat, comprising:

a clutch installed in the outboard motor to be engaged from a neutral position with at least one of a forward gear that causes the boat to be propelled in a forward direction and a reverse gear that causes the boat to be propelled in a direction reverse to the forward direction;

a shift rod movably installed in the outboard motor;

an actuator installed in the outboard motor to move the shift rod; and a shift slider installed in the outboard and connected to the shift rod to slide to at least one of a position at which the clutch is engaged with the forward gear and a position at which the clutch is engaged with the reverse gear, wherein the actuator drives the shift rod to rotate such that the shift slider slides to at least one of the position at which the clutch is engaged with the forward gear and the position at which the clutch is engaged with the reverse gear, and wherein the angular range of rotation is approximately plus/minus 90 degrees when a position at which the clutch is at the neutral position is defined as zero degrees.

6. A shift mechanism according to claim 1, wherein the actuator is an electric motor.

7. A shift mechanism according to claim 1, wherein the actuator drives the shift rod to move in a longitudinal direction such that the shift slider slides to at least one of the position which the clutch is engaged with the forward gear and the position at which the clutch is, engaged with the reverse gear.

8. A shift mechanism according to claim 7, wherein the actuator is an electromagnetic solenoid.

9. A shift mechanism according to claim 7, wherein the actuator is a hydraulic cylinder.

* * * * *